United States Patent [19]

Cordeiro

[11] 4,063,753

[45] Dec. 20, 1977

[54] RUNAWAY BINDING DEVICE FOR A SKI

[76] Inventor: Raymond L. Cordeiro, 22343 S. Garden Ave. No. 1, Hayward, Calif. 94541

[21] Appl. No.: 669,231

[22] Filed: Mar. 22, 1976

[51] Int. Cl.[2] ..... A63C 9/00

[52] U.S. Cl. ..... 280/637

[58] Field of Search ..... 280/637, 611, 622, 619

[56] References Cited

U.S. PATENT DOCUMENTS

| | | | |
|---|---|---|---|
| 2,793,869 | 5/1957 | Braun | 280/637 X |
| 2,959,424 | 11/1960 | Richards | 280/637 |
| 3,452,999 | 7/1969 | Salomon | 280/637 |
| 3,549,163 | 12/1970 | Wiedermann | 280/637 |
| 3,796,438 | 3/1974 | Zimmet | 280/637 |
| 3,884,488 | 5/1975 | Riedel | 280/637 |

FOREIGN PATENT DOCUMENTS

| | | | |
|---|---|---|---|
| 2,250,683 | 4/1974 | Germany | 280/622 |

*Primary Examiner*—Joseph F. Peters, Jr.
*Assistant Examiner*—Milton L. Smith
*Attorney, Agent, or Firm*—Theodore J. Bielen, Jr.

[57] ABSTRACT

A runaway binding device for a ski utilizing strap means for substantially surrounding the leg of the user. The first and second ends of the strap means secures to latch means, the first end being freed upon exertion of pressure on an ear portion of the latch means. Connecting means holds the strap means and attached latch means to the ski.

9 Claims, 6 Drawing Figures

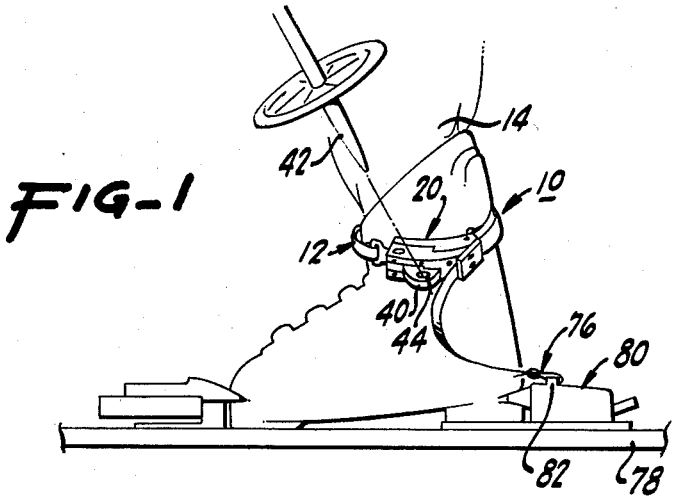
FIG-1
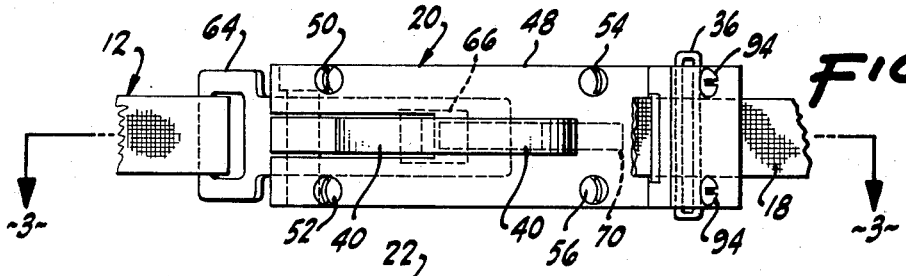
FIG-2
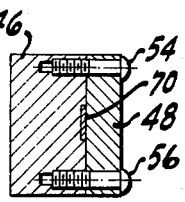
FIG-5
FIG-6
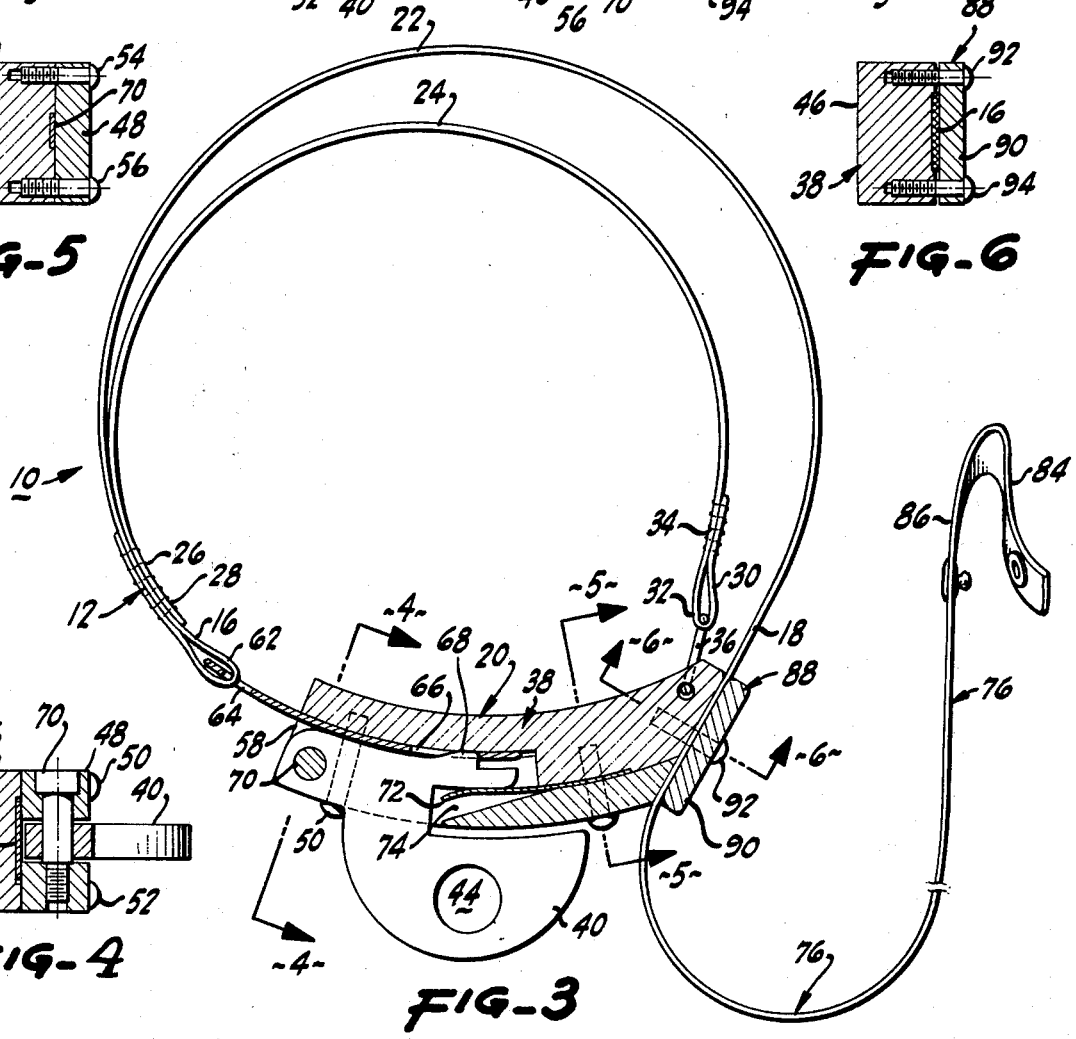
FIG-3
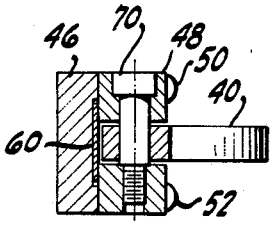
FIG-4

RUNAWAY BINDING DEVICE FOR A SKI

BACKGROUND OF THE INVENTION

The present invention relates to a novel runaway binding device for a ski.

The modern ski binding and ski designedly separate from a skier's boot when a skier falls, thus preventing injury to the skier. The released binding and ski often will continue down a slope, causing an inconvenience in the recovery of the ski and binding or resulting in the loss of the same. More seriously, the loose ski and binding may injure other persons on the ski slope.

Runaway straps have been devised to hold the ski and binding to the leg of the skier. In most alpine ski areas runaway straps are required by automated lift regulation. Early runaway binding models took the form of leather straps that fastened to the ski or binding and buckled or tied around the ski boot. This genre of runaway straps is difficult to use, especially in cold and icy mountain climes. The skier must remove the gloves or mittens protecting his hands to manipulate the buckle or tie. Also, the fastening or securing of the runaway strap entails exhausting effort, especially noticeable at higher altitudes. In the case of a spill, the refastening of the ski and binding to the ski boot, first requires the removal of the runaway strap. Digging for the ski in deep snow and twisting of the body to the proper position, as well as rolling up a pant leg, for the execution of this maneuver, can tire a skier to the point where he takes a subsequent very serious fall, possible an injurious fall, due to his fatigue.

Prior ski binding inventions have focused on quick and easy entry and release of only the ski binding. For example, the U.S. Pat. No. 2,793,869, issued 28 May 1957 to Braun, describes a ski binding releasable by the application of a pressing force by a ski pole.

A later U.S. Pat. No. 3,549,163 issued 22 Dec. 1970, to Wiederman, conceives of a semi-rigid member which clips to a hook-like member affixed to the ski boot. The device requires alteration of the ski boot and may interfere with the working of the ski binding itself, particularly with the application of lateral stresses.

A recent U.S. Pat. No. 3,796,438, issued 12 March 1974, to Zimmet, utilizes a spring loaded resilient member which fits into a locking member which itself attaches to a boot encircling strap. The strap releases by pushing on a button. The spring mechanism of this device may freeze up in cold weather and release of the resilient member from the locking mechanisms is best done manually which requires the skier to bend and the like, in order to effect release.

None of the prior devices solves the problem of providing a runaway binding which may be quickly and simply removed without exerting excessive energy on the part of the skier.

SUMMARY OF THE INVENTION

In accordance with the present invention a runaway binding device for a ski is provided utilizing strap means for substantially surrounding the leg of the user skier. The strap connects at both ends to latch means which includes an ear accesible to the user's hand, ski pole tip and the like. Pressure exerted by the user on the ear frees the first end of the strap means, thus releasing the runaway binding's hold on the skier's leg.

Connecting means holds the strap means and latch means to the ski, either by direct attachment to the ski or by attachment to the ski or by attachment to a binding affixed to the ski.

The strap means may include an elastic portion which exerts a tensile or pulling force on the first end portion of the strap means away from the latch means. The elastic portion may be integral with the first and second end portions or may connect thereto. In any case, the first end of the strap means portion possesses a constant puling tension on the latch means, to permit quick and efficient removal of the runaway binding device.

The latch means may take the form of a housing having an internal slot pen to the exterior portion of the housing. A tongue connected to the first end portion of the strap means having an opening through one of its dimensions fits within the housing slot. The ear includes a catch which fits with the tongue's opening retaining the tongue within the housing slot against the pulling tension of the strap means. The ear having the catch pivots within the housing while the catch engages or disengages the tongue opening. Spring means may be included to bias the pivoting catch into the tongue opening. Thus, the pressure needed to unlatch the device opposes the pressure of the spring means. The present invention may be construed to encompass the feature of constructing an integral strap means and connecting means. A stop may be included to selectively adjust the length of the integral strap means and connecting means. The stop may locate on the latch means in the vicinity of the latch means.

Although the latch may take many forms, the exterior thereof may follow the contour of the rear or sides of a ski boot.

It is therefore an object of the present invention to provide a runaway binding device for a ski to prevent the loss of the ski when a conventional ski binding releases the ski.

It is another object of the present invention to provide a runaway binding device which affixes a ski to the skier's leg easily and efficiently.

It is yet another object of the present invention to provide a runaway binding device releasable solely by the exertion of pressure by a ski pole, the user's hand, and the like, without digital manipulation or compound actions.

Another object of the present invention is to provide a runaway binding device useable in extremely cold windy and icy conditions and in climates of the same nature.

Another object of the present invention is to provide a runaway binding device for a ski which will increase the general safety of alpine ski slopes as well as prevent injury to users of the device.

Still another object of the present invention is to provide a runaway binding device for a ski which aids in the conservation of effort by a skier and enhances the enjoyment of the sport of skiing.

The invention possesses other objects and advantages especially as concerns particular features and characteristics thereof which will become apparent as the specification continues.

BRIEF DESCRIPTION OF THE DRAWINGS

FIG. 1 is a side partially broken view in elevation of the device in use.

FIG. 2 is a partially broken side view of a portion of the device.

FIG. 3 is a top plan view of the device generally taken along line 3—3 of FIG. 2.

FIG. 4 is a view taken along line 4—4 of FIG. 3.
FIG. 5 is a view taken along line 5—5 of FIG. 3.
FIG. 6 is a view taken along line 6—6 of FIG. 3.

DESCRIPTION OF THE PREFERRED EMBODIMENTS

The invention in its entirety is denoted by by reference character 10 and includes as one of its elements, strap means 12 for partially surrounding or encircling the leg 14 of the user. The strap means 12 has a first end portion 16 and a second end portion 18 which are secured by latch means 20. Strap 12 and latch means 20 substantially surround the leg 14, FIG. 1.

Strap means 12 may include a flat elongated band 22 between end portions 16 and 18. The band 22 may preferably be fashioned from any flexible material such as leather, nylon webbing, link metal, canvas, and the like, but a wear-resistant material would best serve the purpose. An embodiment of the invention might include an elastic portion 24 of strap means 12, FIG. 3.

As depicted in the drawings, elastic portion 24 may take the form of an elastic band fastened to the end portion 16 of strap means 12 via stitching 26 at the elastic portion's one end 28 and fastened to latch means 20 at the elastic portion's other end 30 by a loop 32 formed by stitching 34. Loop 32 links to U-shaped bar 36 which pivotally attaches to latch means housing 38. Elastic portion 24 may connect to end portions 16 and 18 as well as to band 22. It is fully understood and anticipated that elastic portion may be constructed integral with band 22, or end portions 16 or 18. For example, a suitable material may be choosen for strap means 12 which exhibits the flexibility and strength of band 22 and end portions 16 and 18 as well as the elasticity of elastic portion 24.

Latch means 20 includes ear 40 which is accessible to the user such that pressure exerted on the ear 40 will free the first end portion 16 of strap means 12. Pressure on ear 40 may be exerted by the user's hands, finger, and any other appendage or extension thereof. Of particular note is the use of ski pole tip 42, FIG. 1, which may engage recess 44 located on ear 40. Recess 44 may be constructed as an opening in ear 40, as well; the criteria being that a ski pole tip readily frictionally engages ear 40. The user generally has the option of using his hands or the ski pole tip when unlatching device 10. The pressure on ear 40 may release strap end portion 16 in a variety of ways. As shown in the drawings, a release pressure directed outwardly with respect to housing 38 will perform this function.

Turning to latch means 20, housing 38 embraces members 46 and 48, which mate and secure with fasteners 50, 52, 54 and 56 of any suitable configuration. As depicted in FIGS. 2 - 6, fasteners 50, 52, 54 and 56 are sheet metal screws. Housing 38 defines slot 58 open to the housing exterior and contoured to fit tongue 60. Loop 62 holds tongue 60 via stitching 26; loop 62 passing through ring 64. Catch 68 engages or fits within a tongue opening 66, FIG. 3. This cooperative arrangement permits the holding of tongue 60 within slot 58.

Ear 40 including catch 68 pivots on pivot pin 70. Spring means 72 biases catch 68 into tongue opening 66. FIG. 3 describes spring means 72 as a leaf spring within cavity 74 which bears on a surface of catch 68. It is fully comprehended that other types of springs may perform the identical function of spring means 72.

Connecting means 76 holds latch means 20 and strap means 12 to the ski 78. In particular, ski binding 80, FIG. 1, provides an eye 82 which accepts riveted loop 84 on the end 86 of connecting means 76 (loop 84 shown exploded in FIG. 3). The connecting means 76 shoud be flexible and exhibit good tensile strength; for example, leather, link metal, and the like are acceptable materials. FIGS. 1 and 2 depict strap means 12 and connecting means 26 integrally formed. Stop 88 on latch means 20 selectively adjusts the length of the strap means 12 and connecting means 76. As preferred, stop 88 includes plate 90 squeezed to members 46 and 48 by the tension of fasteners 92 and 94. Integral strap means 12 and connecting means 76 are straddled by fasteners 92 and 94, FIGS. 2, 3 and 6.

The latch housing 38 and tongue 60 of latch means 20 may be formed to the contour of the ski boot 96 of the skier. This feature results in a comfortable fit of the device 10.

In operation, the user places his boot in or near the ski binding 80 after affixing connecting means 76 thereto. The strap means 12 adjusts via stop 88 such that tongue 60 fits within slot 58, activating catch 68 to engage tongue opening 66. Ear 40 is placed in a convenient spot on ski boot 96. If the ski boot 96 releases from binding 80, the connecting means 76 will retain the ski 78 to the skier's leg.

When release of the device 10 is desired, the user applies pressure, utilizing ski pole 42 and the like, to ear 40 which releases tongue 60 from catch 68 within slot 58.

In the embodiment including elastic portion 24 of strap means 12, disengagement of the tongue 60 and catch 68 will be aided by the same.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A runaway binding device for a ski comprising:

a. strap means for partially surrounding the leg of the user, said strap means having a first end portion and a second end portion;

b. latch means for securing said first and second end portions of said strap means together, said latch means including a housing having a slot open to the exterior of said housing and a tongue passing into and out of said housing slot along substantially the same path of travel, said tongue having an opening therethrough and being connected to said first end portion of said strap means, said latch means also including an ear pivotally mounted at one edge thereof on said housing and having an accessible portion extending outwardly from said housing, said ear including a catch fitting within said tongue opening to retain said tongue within said housing slot, pivotal movement of said ear outwardly from said housing releasing said catch retaining said tongue, said latch means further including spring means for biasing said pivoting catch into said tongue opening, said catch and said tongue cooperable to permit retaining of said tongue by said catch along said path of travel, said latch means and strap means substantially surrounding the leg of the user; and c. connecting means for holding said strap means to the ski.

2. The runaway binding device of claim 1 in which said strap means includes an elastic portion that exerts a pulling force on said first end portion of said strap means away from said latch means.

3. The runaway binding device of claim 2 in which said ear's accessible portion presents a surface engagable by a ski pole tip for applying said pressure on said ears accessible portion outwardly from said housing.

4. The runaway binding device of claim 1 in which said strap means and said connecting means are integral and said device further includes a stop to selectively adjust the length of said strap means and said connecting means.

5. The runaway binding device of claim 4 in which said strap means includes an elastic portion that exerts a pulling force on said first end portion of said strap means away from said latch means.

6. The runaway binding device of claim 5 in which said ear's accessible portion presents a surface engagable by a ski pole tip for applying said pressure on said ear's accessible portion outwardly from said housing.

7. The device of claim 6 in which said surface of said ear's accessible portion includes a recess to engage said ski pole tip.

8. The device of claim 1 in which said spring means is interposed between said catch and said accessible portion of said ear.

9. The device of claim 1 in which said housing slot and said tongue are contoured to fit around the leg of the user.

* * * * *